US005887994A

United States Patent [19]

Nomura et al.

[11] Patent Number: 5,887,994

[45] Date of Patent: Mar. 30, 1999

[54] BEARING MECHANISM AND INK JET RECORDING APPARATUS HAVING SAME

[75] Inventors: Akihiro Nomura, Yokohama; Akio Takeda, Kawasaki, both of Japan

[73] Assignee: Canon Kabushiki Kaisha, Tokyo, Japan

[21] Appl. No.: 869,224

[22] Filed: Jun. 4, 1997

Related U.S. Application Data

[63] Continuation of Ser. No. 657,499, Jun. 4, 1996, abandoned, which is a continuation of Ser. No. 396,086, Feb. 28, 1995, abandoned, which is a continuation of Ser. No. 181,869, Jan. 13, 1994, abandoned, which is a continuation of Ser. No. 599,860, Oct. 19, 1990, abandoned.

[30] Foreign Application Priority Data

| | | | |
|---|---|---|---|
| Oct. 20, 1989 | [JP] | Japan | 1-274301 |
| Oct. 22, 1989 | [JP] | Japan | 1-274471 |
| Oct. 22, 1989 | [JP] | Japan | 1-274472 |

[51] Int. Cl.[6] ..... B41J 11/22

[52] U.S. Cl. ..... 400/352; 400/354; 384/408; 184/100

[58] Field of Search ..... 400/352, 407, 400/408; 358/296; 184/5, 64, 100; 384/407, 408

[56] References Cited

U.S. PATENT DOCUMENTS

| | | | |
|---|---|---|---|
| 1,184,050 | 5/1916 | Toeplitz | 384/408 |
| 3,235,317 | 2/1966 | Cunningham | 384/408 |
| 3,250,932 | 5/1966 | Tupper | 384/408 |
| 3,940,189 | 2/1976 | Renk et al. | 384/408 |
| 3,985,404 | 10/1976 | Plaza et al. . | |
| 4,005,913 | 2/1977 | Thomson, Jr. . | |
| 4,313,124 | 1/1982 | Hara | 346/140 R |
| 4,345,262 | 8/1982 | Shirato et al. | 346/140 R |
| 4,459,600 | 7/1984 | Sato et al. | 346/140 R |
| 4,463,359 | 7/1984 | Ayata et al. | 346/1.1 |
| 4,476,496 | 10/1984 | Thaler | 358/296 |
| 4,558,333 | 12/1985 | Sugitani et al. | 346/140 R |
| 4,571,011 | 2/1986 | Muto et al. . | |
| 4,599,006 | 7/1986 | Abel | 384/408 |
| 4,723,129 | 2/1988 | Endo et al. | 346/1.1 |
| 4,740,796 | 4/1988 | Endo et al. | 346/1.1 |
| 4,755,877 | 7/1988 | Vollert | 358/88 |
| 4,772,899 | 9/1988 | Mamiya et al. . | |
| 5,053,792 | 10/1991 | Une | 400/719 |
| 5,070,410 | 12/1991 | Hadely | 358/296 |

FOREIGN PATENT DOCUMENTS

| | | |
|---|---|---|
| 54-054024 | 4/1979 | Japan . |
| 54-56847 | 5/1979 | Japan . |
| 59-123670 | 7/1984 | Japan . |
| 59-138461 | 8/1984 | Japan . |
| 60-71260 | 4/1985 | Japan . |
| 60-148350 | 8/1985 | Japan . |
| 01-156073 | 6/1989 | Japan . |

*Primary Examiner*—John Hilten

*Attorney, Agent, or Firm*—Fitzpatrick, Cella, Harper & Scinto

[57] ABSTRACT

A bearing mechanism includes a shaft for guiding a reciprocable carriage; a bearing mounted on the carriage and slidable relative to the shaft; a receiving member extending from the bearing to receive lubricant oil removed by the sliding movement between the shaft and the bearing; and a lubricant oil passage formed in the bearing to connect the receiving member and a portion between the shaft and the bearing.

6 Claims, 14 Drawing Sheets

BEARING MECHANISM AND INK JET RECORDING APPARATUS HAVING SAME

This application is a continuation of application Ser. No. 08/657,499 filed Jun. 4, 1996, now abandoned, which is a continuation of application Ser. No. 08/396,086 filed Feb. 28, 1995, abandoned, which is a continuation of application Ser. No. 08/181,869 filed Jan. 13, 1994, abandoned, which is a continuation of application Ser. No. 07/599,860 filed Oct. 19, 1990, abandoned.

FIELD OF THE INVENTION AND RELATED ART

The present invention relates to a bearing mechanism particular to a carriage reciprocally movable along a shaft and to an ink jet recording apparatus having such a bearing mechanism.

A printer, reader or the like has a carriage for carrying a recording head or a reading element, and the carriage is reciprocated along a shaft. For the lubrication for the reciprocal sliding movement, a lubricant oil is used. Since the bearing area for the sliding is relatively large, the lubricant oil is relatively quickly consumed. Therefore, use of an oil pad impregnated with the lubricant oil is considered.

FIG. 1 shows an example using such an oil pad in the bearing mechanism, wherein the carriage is shown as carrying a reader for reading an image. The reading system comprises a halogen lamp 17, a reading opening 16A, a reflection shade 16, a light blocking plate 18. Designated by references 19 and 19A are electrical parts and cable.

The carriage 14 is supported on a rail (shaft) 1A, and is engaged with a belt 15. By pulling the belt 15 by an unshown driving source, the carriage 14 slides to the left and the right (arrow B) to scanningly read the image. Between the carriage 14 and the rail 1A, a bearing 13 is disposed at each side. Between the two bearings, an oil pad 6 is supported on the rail 1A. The oil pad 6 is impregnated with the lubricant oil to supply the lubricant oil to the rail 1A.

FIG. 2 is a sectional view, wherein an oil collecting felt 7 (collecting pad) is disposed at an outside of each bearing 13 at opposite sides to collect the lubricant oil scraped outwardly from the rail 1*a*. By doing so, the efficient use of the lubricant oil is intended. Each collecting pad 7 is supported by a holder 8 at each side.

When an original having A4 size is read with 10 mm increments, or when recording is effected on A4 size sheet with the same increment, the carriage is required to reciprocate 30 times, since the longitudinal dimension of the A4 size is 297 mm. Therefore, the reader or printer has the service life of 50,000 sheets, the carriage has to be durable to the 1,500,000 reciprocations. If the reader or the printer is of such a type wherein servicemen attend to the maintenance operation, the oil may be applied several times during the service life. However, if the reader or the printer is of a disposable type, it is desired that the lubricant oil works throughout the service life.

Even if the structure of FIG. 2 is employed, it is difficult to maintain the lubricant oil for the long period of time. A large quantity of oil is required to be contained in the oil pad 6, since otherwise the oil becomes insufficient before the end of the service life, with the possible result of degraded reading or recording.

Then, increase of the quantity of the lubricant oil is considered. If it is done, there occurs a liability that a part of the lubricant oil is accumulated at an end of the bearing 13, and the accumulated oil falls, as shown by reference numeral 20 in FIG. 3. Such oil is not reusable and therefore wasteful. In addition, the service life does not increase as expected.

If the collecting pads 7 are not used, the oil flows out also from the outer opposite sides of the bearings 13, with the result of increase of the wasted oil.

SUMMARY OF THE INVENTION

Accordingly, it is a principal object of the present invention to provide a bearing mechanism and an ink jet recording apparatus having the same wherein the quality of the image reading operation or the image recording operation is enhanced.

It is another object of the present invention to provide a bearing mechanism and an ink jet apparatus having the same wherein the service life of the lubricating system is significantly increased.

It is a further object of the present invention to provide a bearing mechanism and an ink jet recording apparatus having the bearing mechanism wherein the lubricant oil is prevented from falling and from contaminating the apparatus.

It is a yet further object of the present invention to provide an ink jet recording apparatus, a reading system or a recording system having a sliding surface sufficiently lubricated by oil, wherein a heat generating part such as motor or the like is efficiently cooled, by which the operation accuracy is maintained, thus assuring the good image recording.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

According to the embodiments which will be described hereinafter, an extension is provided from the bearing to receive the oil scraped by the sliding action between the shaft and the bearing, and therefore, the oil is accumulated on the extension. The accumulated oil is returned to the sliding part therebetween in accordance with reduction of the oil at the sliding part through oil returning passage such as groove or grooves provided. Therefore, the service life of the lubricating system is significantly expanded.

In a further embodiment, an inward flange is provided on the extension, by which the lubricant oil is further assuredly accumulated on the extension.

Figure 1:
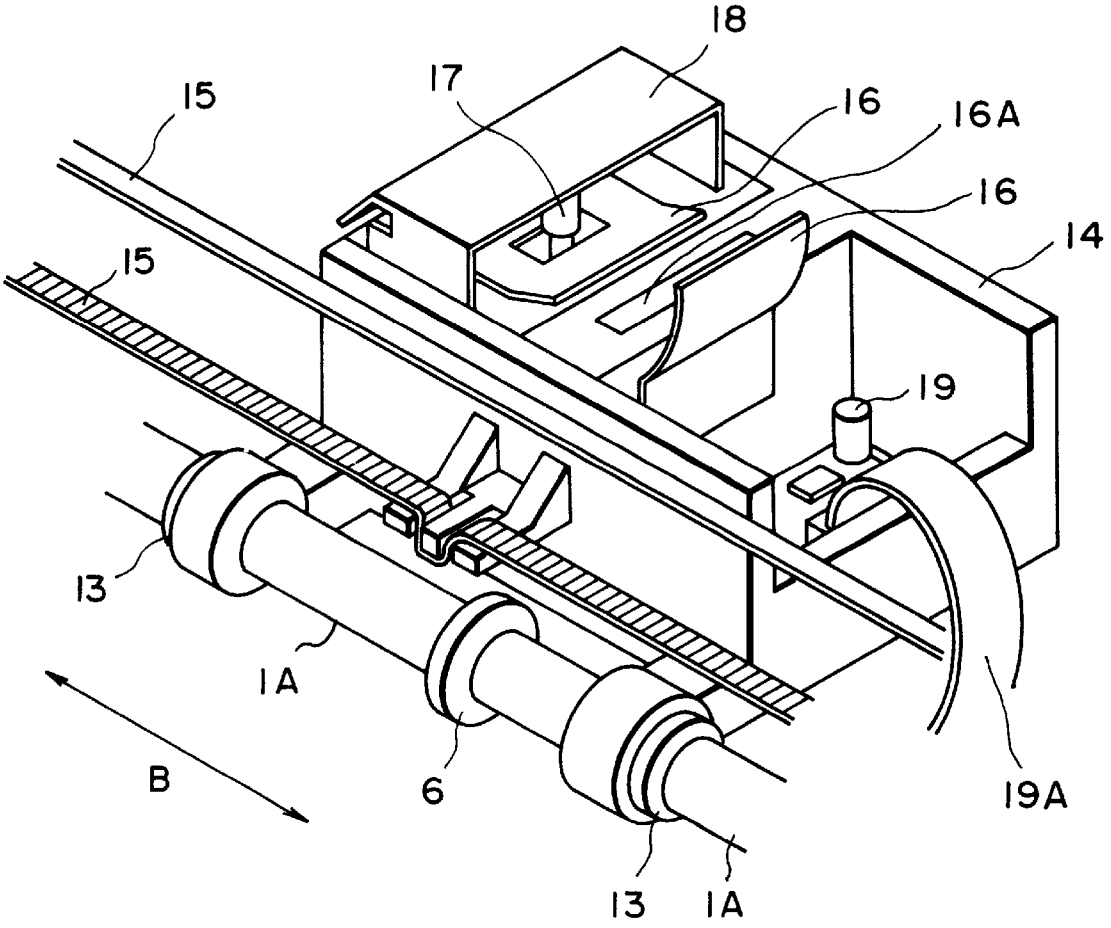
FIG. 1 is a perspective view of a carriage for carrying an image reading element to illustrate an example of a bearing mechanism.
Figure 2:
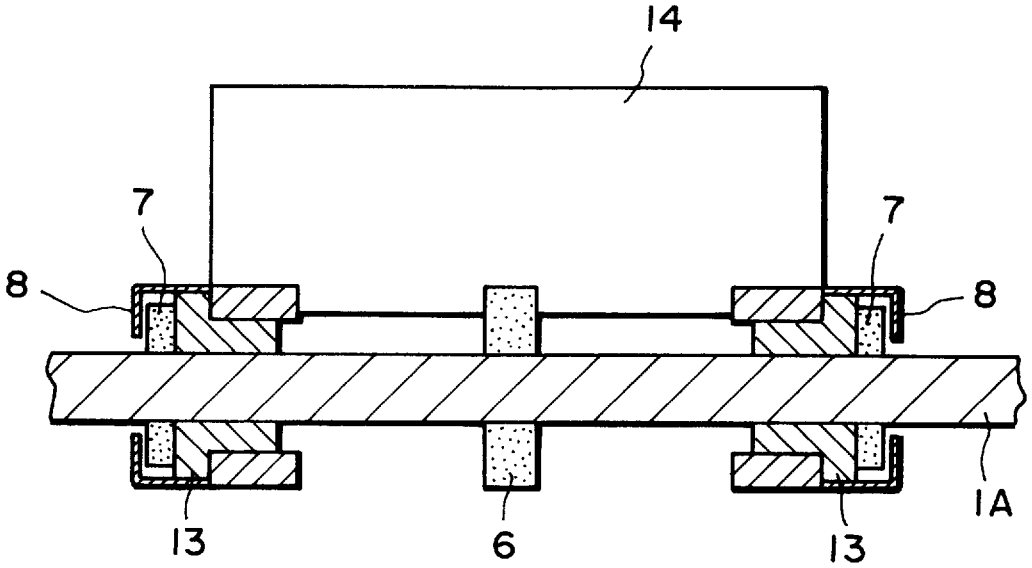
FIG. 2 is a sectional view of FIG. 1 system wherein an oil collecting felt is disposed at each of the outer sides of the bearing to collect the oil scraped outwardly by the bearings.
Figure 3:
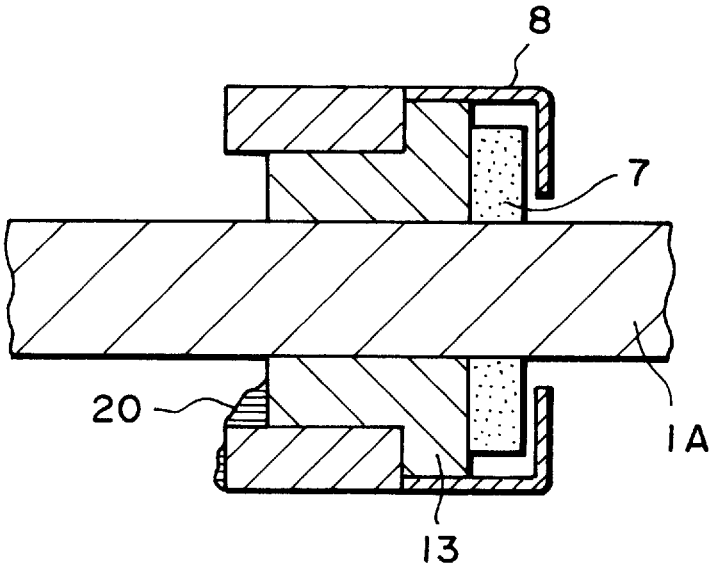
FIG. 3 is an enlarged view of a major part of the system of FIG. 1.
Figure 4:
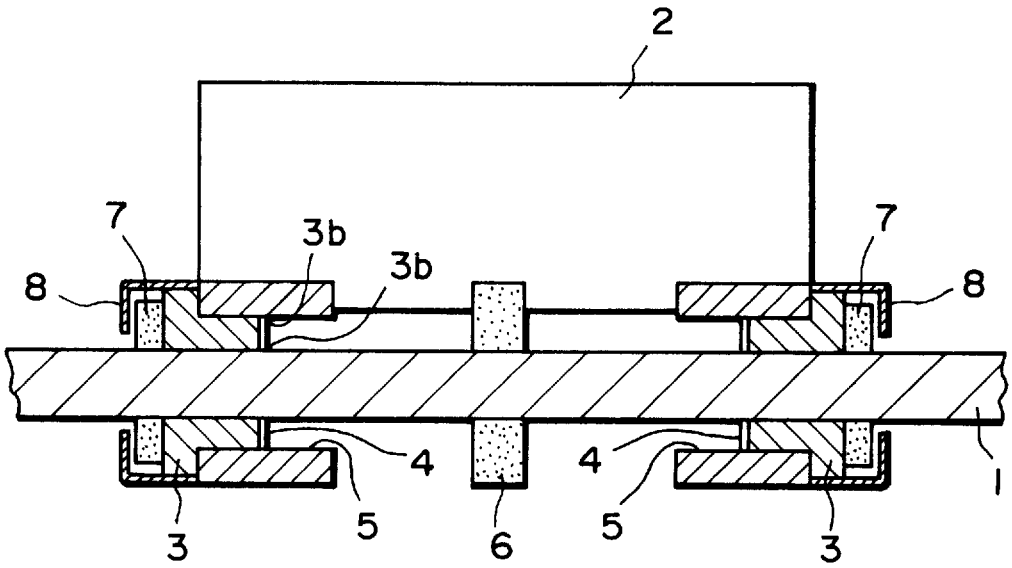
FIG. 4 is a sectional view of a major part including the carriage, according to an embodiment of the present invention.

FIG. 4 shows the bearing mechanism, according to an embodiment of the present invention. In this embodiment, two bearings 3 are provided symmetrically. The structures of the carriage itself and the connection with the belt 15, or the like, are the same as shown in FIG. 1, and the detailed descriptions thereof are omitted.

The bearings 3 are fixedly mounted on the carriage 2, and are each provided with an extension in the form of a collar 5. Radial grooves 4 are formed to connect the inside surface 3*a* of the collar 5 and the outer surface 3*b* of the shaft 1, in other words, to connect the extension 5 and the sliding portion between the shaft (rail) 1 and the bearing 3. The grooves function as passages for the lubricant oil. An oil pad 6 is fixed on the carriage 2 so as to be movable together with the carriage 2.

Figure 5:
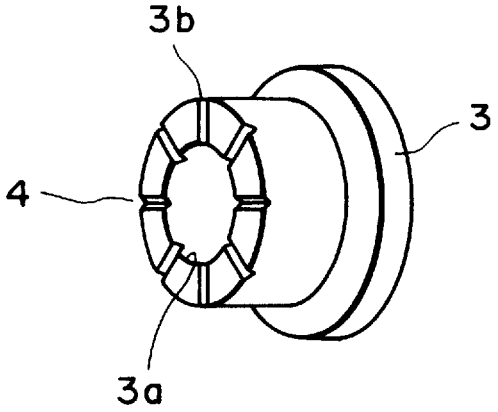
FIG. 5 is a perspective view of the bearing used in FIG. 1 structure.

FIG. 5 is a perspective view of the bearing 3 of FIG. 4. As will be understood from this Figure, the bearing 3 is provided with plural radial grooves 4.

Figure 6A:
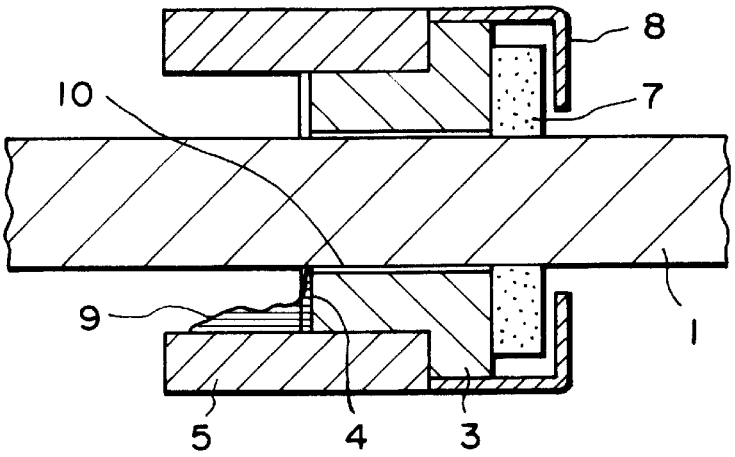
FIGS. 6A, 6B and 7 are sectional views illustrating advantageous effects of the first embodiment of the present invention.
Figure 6B:
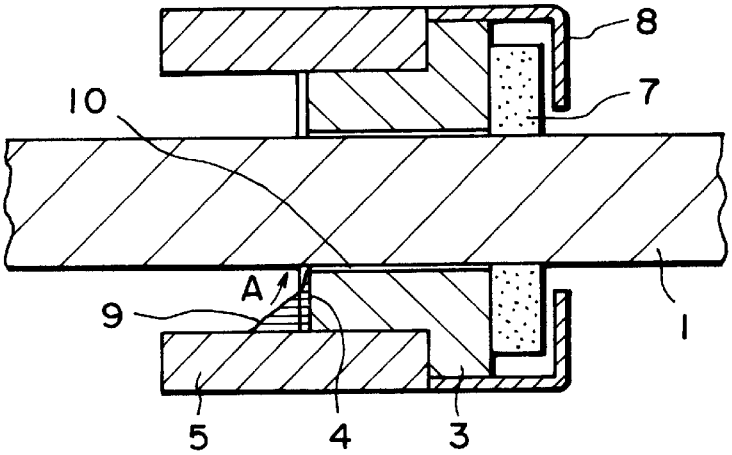

Referring to FIGS. 6A and 6B, the effects of the present embodiment will be described. A part of the lubricant oil (commercially available oil) contained in the oil pad 6 (FIG. 4), is collected by the collecting pad 7 fixed at outside end of each of the bearings 3, and the remainder is scraped by an end edge of the bearing 3 and is accumulated on the extension 5, as indicated by a reference numeral 9 in FIG. 6A. The extension 5 has sufficient longitudinal dimension (5–13 mm in this embodiment) corresponding to the quantity of the lubricant oil which will be accumulated on the extension 5, and therefore, all of the scraped lubricant oil is accumulated there. Since the end surface of the bearing 3 is provided with the grooves 4, and since the grooves 4 extend radially from the outer periphery 3*b* of the shaft to the inner periphery of the extension 3*a*, the oil accumulated on the extension 4 fill all or a part of the grooves 4 by capillary action to be connected with the lubricant oil on the sliding surface 10.

This is the essential difference from the structure shown in FIG. 1. The tendency of the lubricant oil expanding on the sliding surface 10 and the overflowing tendency thereof are balanced to establish the state shown in FIG. 6A, so that the loss of the lubricant oil is minimized.

When the balance is disturbed by the reduction of the lubricant oil on the sliding surface 10 by the consumption, the lubricant oil 9 on the extension 5 moves by the capillary action in a direction indicated by an arrow A in FIG. 6B to expand on the sliding surface 10, so that a new balance is established.

Thus, the overflowing oil 9 gradually returns to the sliding surface 10 by the consumption of the lubricant oil on the sliding surface 10, and therefore, the quantity of the lubricant oil can be used up without waste.

Figure 7:
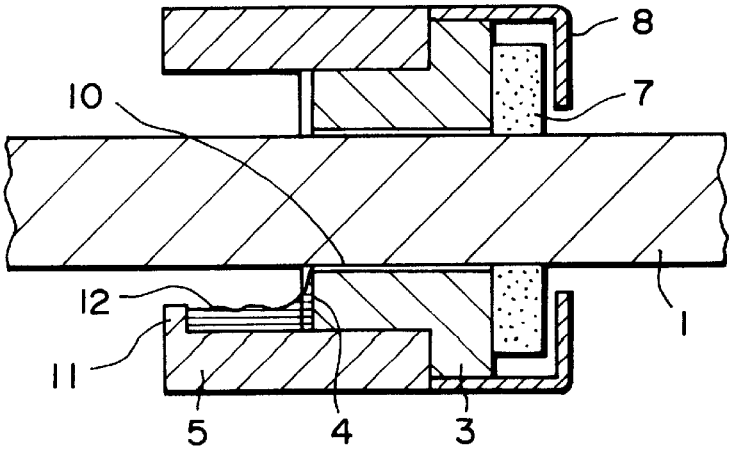

Referring to FIG. 7, a second embodiment will be described, wherein an inward (vertical) flange 11 is provided at an inside end of the extension 5, as shown in this Figure. According to this embodiment, a further increased quantity of the lubricant oil 12 can be accumulated. Such a flange is not absolutely necessary, depending on the required service life of the lubricating system.

Figure 8:
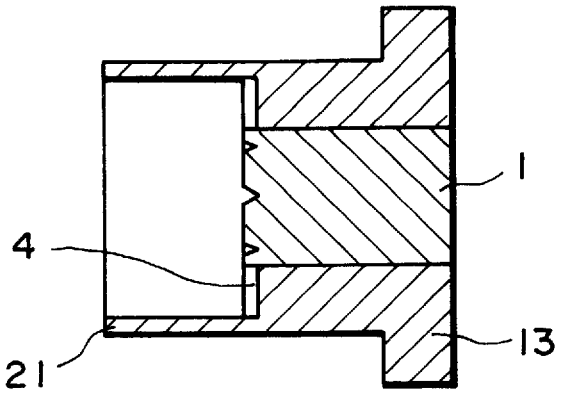
FIGS. 8, 9, 10 and 11 are sectional views illustrating other embodiments of the present invention.

Referring to FIG. 8, a third embodiment will be described, wherein the extension 21 is integrally formed with the bearing 13. The advantageous effects can be provided with this structure. In all of the embodiments of the present invention, the extension is described as a collar or a cylindrical part, but the configuration thereof is not limited, and may be in any other form if it can accumulate the lubricant oil.

Figure 9:
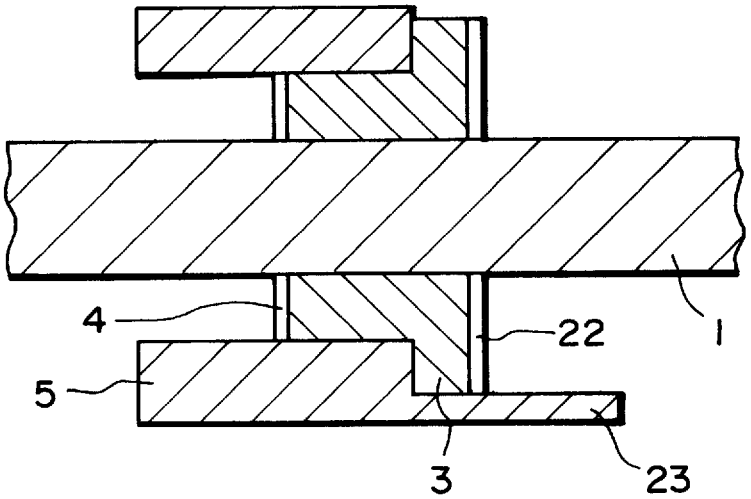

Referring to FIG. 9, there is shown a fourth embodiment. In this embodiment, in place of the collecting pad 7 in the foregoing embodiment, a combination of the grooves 22 and an outward extension 23 is used. The lubricant oil on the extension 23 and the extension 5 are connected with the oil on the sliding surface 10 through the grooves 4 and the grooves 22. According to this embodiment, the lubricant oil is recirculated more efficiently.

Figure 10:
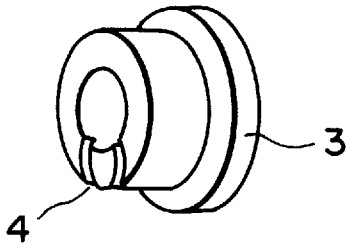

FIG. 10 is a perspective view of a fifth embodiment. In this embodiment, the groove 4 is arcuated, as shown. As will be understood, the groove is not limited to a rectilinear groove. It will suffice if it efficiently connects the sliding surface 10 and the extension 5. A large number of the grooves are not required, but the number may be one or more provided at the position where the oil accumulates.

Figure 11:
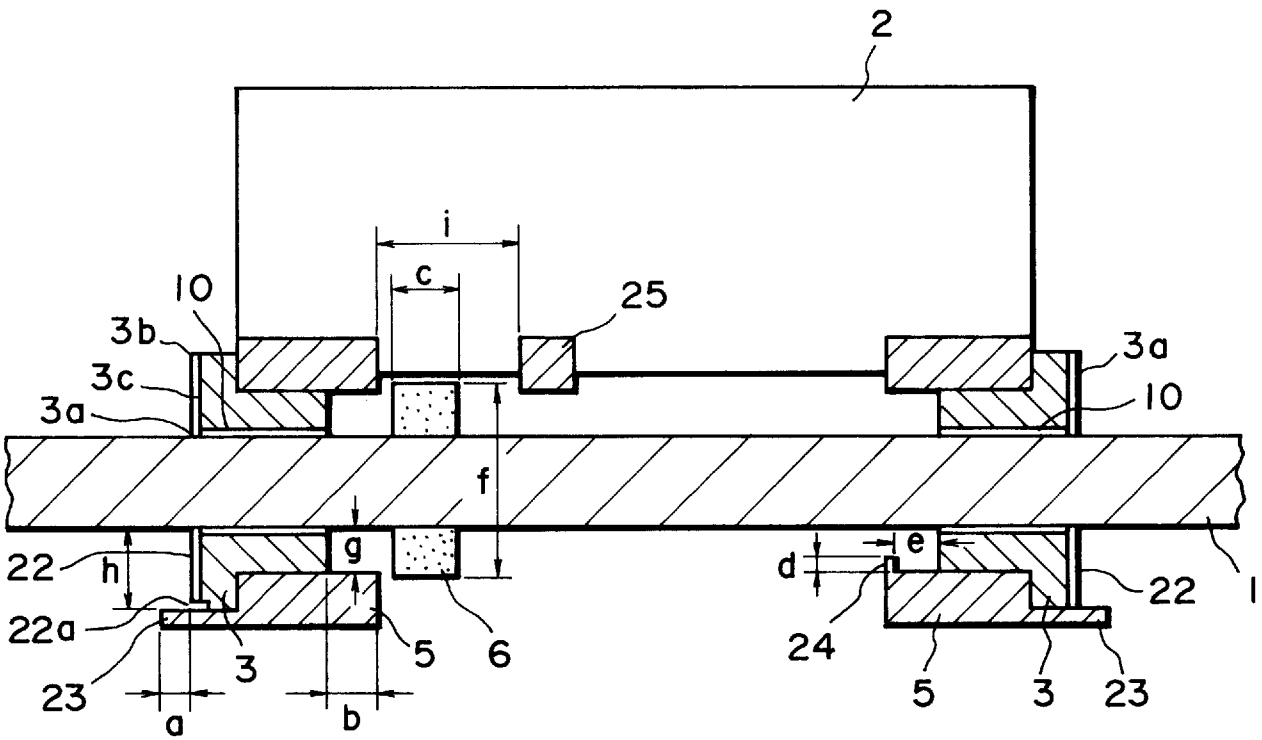

FIG. 11 shows a sixth embodiment, wherein a freely movable oil pad 6 is used. The grooves 22 are formed only in a flange 3*a* of the bearing 3. In this embodiment, the carriage 2, the left and right bearings 3, the extensions 5, the extensions 23, the inward flange 24 and a stopper 25 are integrally formed by molding.

The left bearing 3 will first be described. Below the flange 3*a* of the left bearing 3, the extension 23 is formed with a small clearance 22*a* (approximately 0.5 mm in this embodiment) from the flange 3*a*. The extension 23 extends outwardly of the bearing 3 below grooves 28 (8 radial grooves 22 are formed circumferential equidistantly, extending between the inside surface 3*a* and the outside surface 3*b*). At the other longitudinal end of the bearing 3, the extension 3 is extended outwardly. The extension 5 is closer to the shaft 1 than the extension 23 is. Between the bearings 3, a stopper 25 is mounted to the bottom of the carriage 2. Between the stopper 25 and the extension 5, an oil pad 6 is movably supported on the shaft 1. On the other hand, the right bearing 3 has an extension 5 and an extension 23, similarly to the left bearing 3. However, the right bearing 3 is provided with an inward (vertical) flange 24 at an end of the extension 5.

With the above structure, when the carriage 2 reciprocates along the shaft 1, the lubricant oil scraped from the sliding surface 10 is accumulated. Similarly to the foregoing embodiment, the lubricant oil is collected back to the sliding surface 22 through the grooves 22 by the capillary action.

Since there is no groove at the central side of the carriage 2 of the left bearing 3, the oil scraped from the sliding surface 10 is accumulated on the extension 5. However, in the example shown in FIG. 11, the oil pad 6 is freely slidable on the shaft 1, it repeats contacts to the extension 5 and to the stopper 25 by the movement of the carriage 2. Therefore, the lubricant oil overflowing from the extension 5 is collected into the oil pad 6 when the oil pad 6 is contacted to the extension 5. On the other hand, the oil pad 6 does not contact to the extension 5 of the light bearing 3, and therefore, an inward flange 24 is formed in order to increase the accumulation capacity of the extension 5. Therefore, the lubricant oil does not overflow from the extension 5. The height of the inward flange 24 is properly determined in accordance with the quantity of the lubricant oil. In this embodiment, if the stopper 25 is not used, the oil pad 6 is contactable to the right extension 6, and therefore, the inward flange 24 can be omitted. However, it is possible that the inward flanges are provided at both of the extensions 5.

This embodiment is advantageous in the following points. First, because of the provision of the clearance 22*a*, the lubricant oil accumulated on the extension 23 enters the clearance 22*a*, and is assuredly lifted from the end of the grooves 22 by the capillary action. As compared with the case wherein the oil is lifted from the middle of the groove 22 (the oil may be lifted from the middle of the grooves 22 depending on the state of oil stagnation), the oil is further assuredly lifted when the lubricant oil is at the bottom end of the grooves. Second, the extension 5 of the left bearing 3 is above or closer to the sliding surface 10 than the extension 23, and therefore, the lubricant oil quickly overflows from the extension 5, so that it is quickly collected into the pad 6.

An example of the dimensions of various parts will be given:

Length of extension of the extension 23 (a): approximately 1.5 mm:

Length of extension of the extension 5 (b): approximately 4 mm:

Width of the oil pad 6 (c): approximately 10 mm:

Height of the inward flange 24 (d): approximately 1.5 mm:

Distance between the inward flange 24 and the bearing 3 (e): approximately 4 mm:

Diameter of the oil pad 6 (f): approximately 18 mm:

Distance between the extension 5 and the shaft 1 (g): approximately 3 mm:

Distance between the extension 23 and the shaft 1 (h): approximately 7 mm: and Distance between the extension 5 and the stopper 25 (i): approximately 14 mm.

Further embodiments of the present invention will be described. Seventh—tenth embodiments which will be described hereinafter are such that the lubricant oil scraped is directed to the opposite side of the bearing through a passage or passages or the like, and thereafter, the oil is returned, thus eliminating loss of the lubricant oil to increase the service life of the lubricating system.

Figure 12:
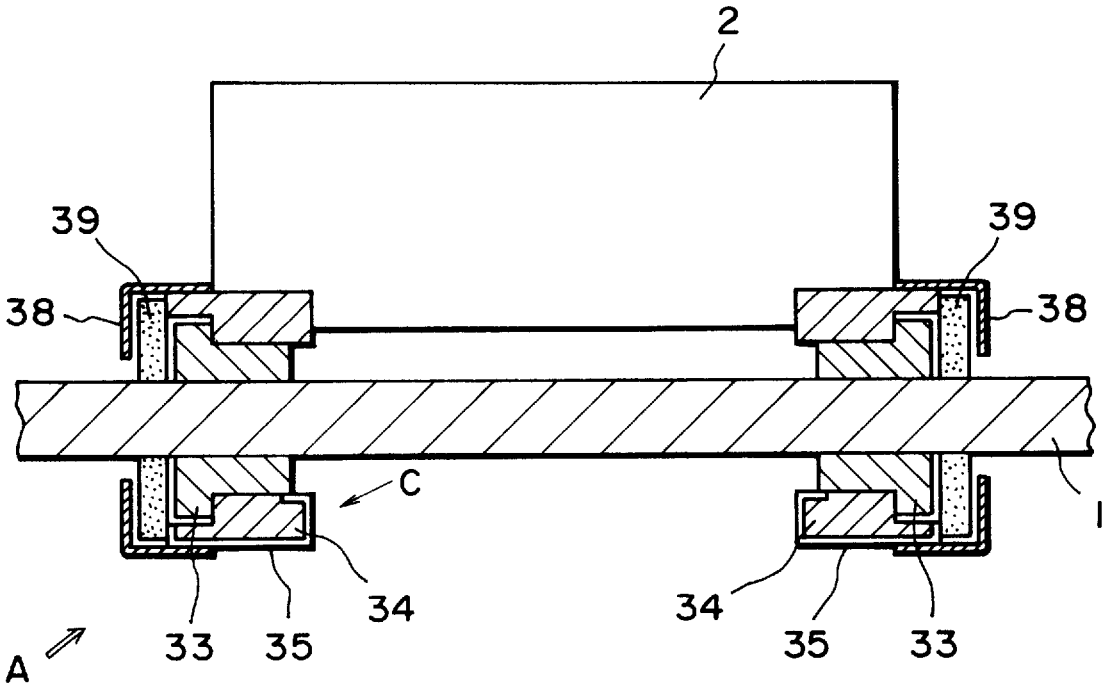
FIG. 12 is a sectional view of a carriage, according to a further embodiment of the present invention.

FIG. 12 illustrates the seventh embodiment, wherein the left and right bearings 33 are symmetrical, and one of the bearings 33 and the grooves 35 therein will be described, and the description of the other bearing will be omitted by assigning the same reference numerals.

In this embodiment, an oil pad 39 functioning as supplying, retaining and collecting the lubricant oil is provided in contact to or close to a bearing member 38 having the bearing 33 and a bearing supporting member 34 for supporting the bearing 33. The oil pad 39 may be fixed on the bearing member 38, or it may be movable between the bearing 33 and the member 38. In the surface of the bearing supporting portion 34, grooves 35 are formed to connect a collecting member 39 and the portion between the shaft 1 and the bearing member 33. The grooves 35 extend from the portion between the shaft 1 and the bearing 33 to the oil pad 39 disposed at the opposite side through an outer periphery of the bearing support member 34.

Figure 13:
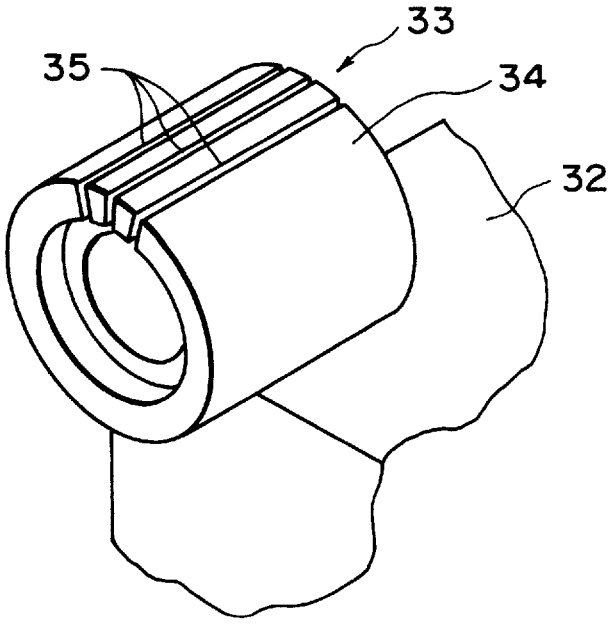
FIG. 13 is a partial enlarged perspective view of the major part of FIG. 12 structure, as shown in the direction A.

FIG. 13 is a partial enlarged perspective view as seen in a direction A of FIG. 12. As will be understood from FIG. 12, the bearing supporting portion 34 has three grooves 35.

Figure 14:
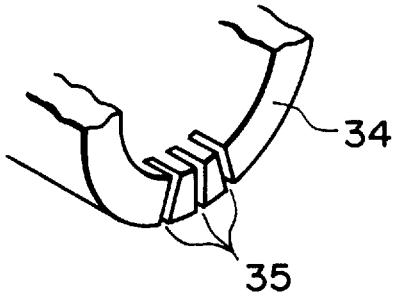
FIG. 14 is a perspective view of grooves of FIG. 12, as seen in a direction C.

FIG. 14 is a partial perspective view of the grooves 35 as seen in a direction C of FIG. 12.

In this embodiment, as contrasted to the structure of FIG. 1, there is no oil pad between the bearings 33. The oil pads 39, at the outsides of the left and right bearings, function to supply and retain the lubricant oil. This structure is employed in this embodiment, because the loss of the lubricant oil is small, and therefore, the total quantity of the initial lubricant oil can be reduced.

Figure 15A:
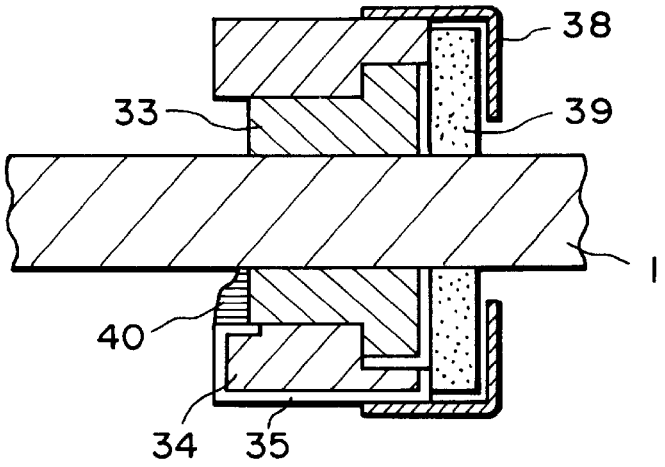
FIGS. 15A, 15B and 15C are sectional views illustrating effects of this embodiment.
Figure 15B:
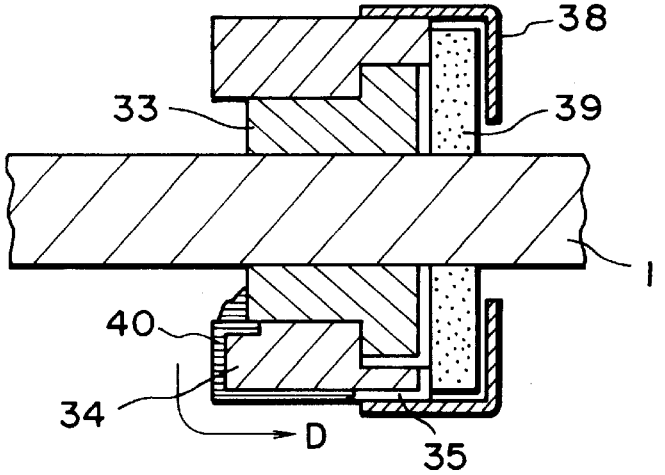
Figure 15C:
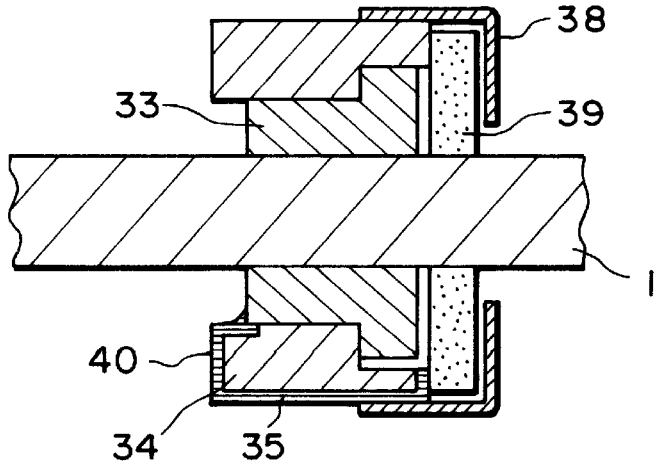

Using FIGS. 15A, 15B and 15C, the effects of the structure of this embodiment will be described. Excessive quantity of the lubricant oil supplied from the oil pad 39 (only one is shown), is scraped by or overflows from the end surface of the bearing 33 by the reciprocating movements thereof. Such oil at the oil pad 39 side (one side), is directly contacted by the oil pad 39 and is absorbed thereby, or the oil falls on the bearing supporting portion 34 and then is collected by the oil pad 39. The lubricant oil 40 at the opposite side from the oil pad 39 (FIG. 15A), moves in the groove 35 formed in the surface of the bearing supporting portion 34 by the capillary action in a direction D in FIG. 15B, to an end surface contacted to the oil pad 39 shown in FIG. 15C. Thus, the oil is contacted to the surface of the oil pad 39 and is collected thereby.

Since the movement of the lubricant oil is on the basis of the capillary action, the oil does not fall by the gravity even if the groove opens downwardly. The lubricant oil can be lifted along the vertical oil in the end surface.

According to the embodiments of the present invention, the excessive lubricant oil which has been wasted hereinbefore can be collected back and is reused, whereby the service life of the lubricating system can be significantly increased.

Figure 16:
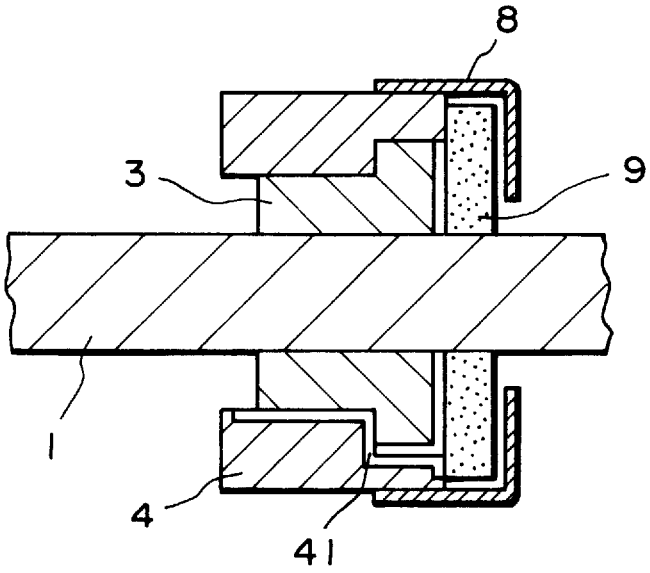
FIGS. 16, 17 and 18 are sectional views illustrating further embodiments of the present invention.

FIG. 16 is a sectional view of a system according to an eighth embodiment of the present invention. In this embodiment, grooves 41 are formed on a contact surface with the bearing 33. The overflowing lubricant oil is not seen from the outside, and is not accessed by an operator's hand.

Figure 17:
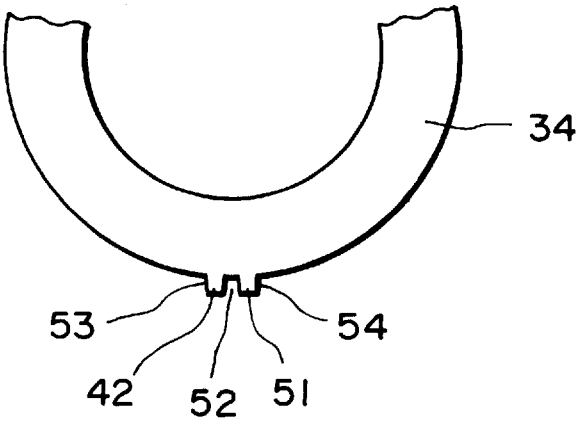

FIG. 17 is a sectional view of an bearing supporting portion 34 in a system according to a ninth embodiment of the present invention. In this embodiment, the groove or grooves are formed by ribs 42 and 51 projected from the bearing supporting portion 34. The portion indicated by a reference numeral 52, and corner portions 53 and 54 are deemed as a groove or grooves, and actually, the lubricant oil moves therealong by the capillary action.

Figure 18:
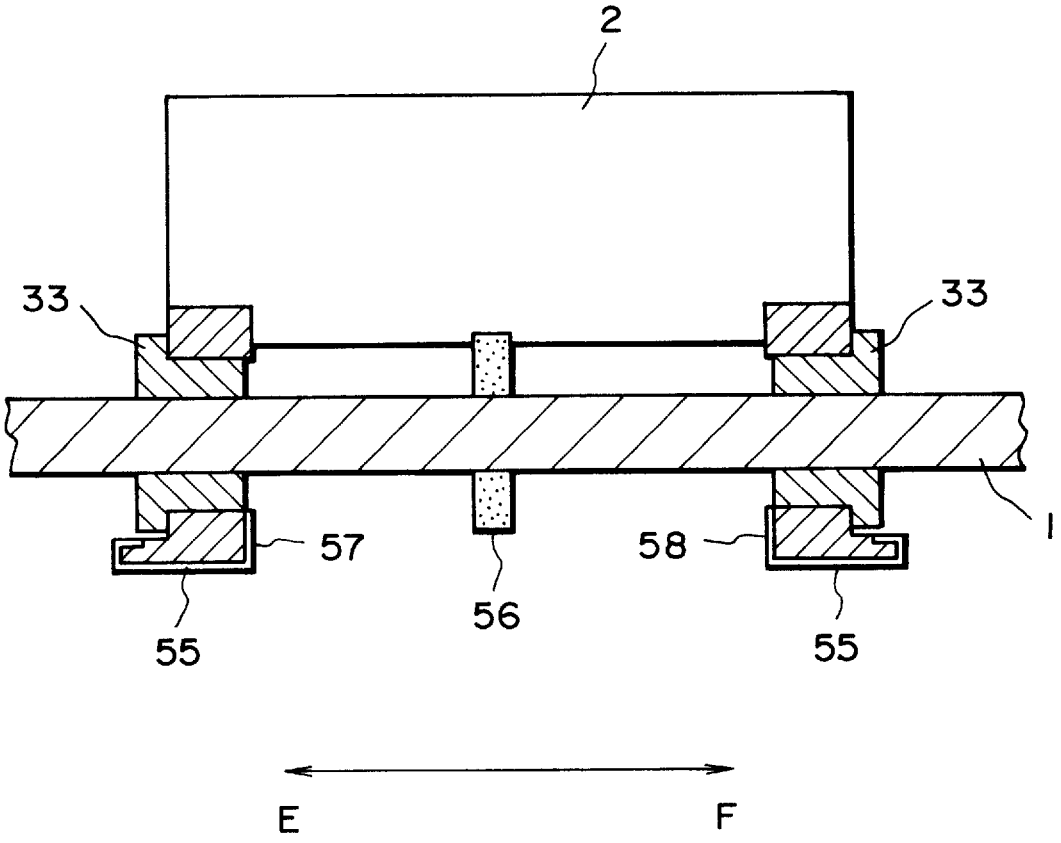

FIG. 18 is a sectional view of a system according to tenth embodiment of the present invention. In this embodiment, an oil pad 56 for retaining and collecting the lubricant oil is movable between the insides of the two bearings 33. When the carriage 2 moves in a detection F, the oil pad 56 is pushed in the detection E to be contacted to the portion indicated by a reference numeral 57, whereas when the carriage 2 moves in the direction E, the oil pad 56 is pushed in the direction F to be contacted to a portion indicated by a reference numeral 58. By repetition of such movements, the lubricant oil removed by the bearings can be collected. The lubricant oil from the outsides of the left and right bearings 33, is directed to the insides by the grooves 55. This embodiment is different from the foregoing embodiments in which the oil pad is always in contact with or is close to the bearing. However, this embodiment is advantageous in that only one pad is sufficient.

In this embodiment, the lubricant oil is efficiently circulated when the width of the grooves is not less than approximately 100 microns and not more than approximately 5 microns, preferably not more than approximately 2 microns. However, the present invention is not limited to these Figures, and the dimensions are properly determined by one skilled in the art depending on the quantity of the lubricant oil to be circulated and the viscosity of the oil.

In each of the foregoing embodiments, the number of the grooves may be one or more depending on the quantity of the lubricant oil to be supplied and the viscosity of the oil.

In this embodiment, the element carried on the carriage is not limited to the reader element. It may be an ink jet recording head or a thermal head or the like. Among them, the present invention is particularly effective to the ink jet recording head of a cartridge type which has an integral ink container containing the ink to be ejected by the recording head, because the weight of the recording head changes significantly depending on the consumption of the ink, and therefore, the present invention by which the tendency of the lubricant oil expanding on the sliding surface 10 and the overflowing tendency of the lubricant oil are balanced is particularly effective to such a recording head.

Referring to FIGS. 19–24, the description will be made as to a copying machine (reader-recorder system) to which the carriage 116 and/or the carriage 137 is applicable. In the copying apparatus which will be described hereinafter, one or more of the foregoing embodiments is incorporated into a reciprocable image reader carriage 116, and an air flow passage is extended from a cross flow fan to a neighborhood of a heat generating element disposed adjacent to the fan, and is opened there. By doing so, the heat generating element can be efficiently cooled. Thus, in this embodiments, the proper amount of the lubricant oil is always at the sliding surface, and in addition, the heat generating element such as the motor is efficiently cooled, by which the operational accuracy can be increased and maintained, so that clear recording is possible.

Figure 19:
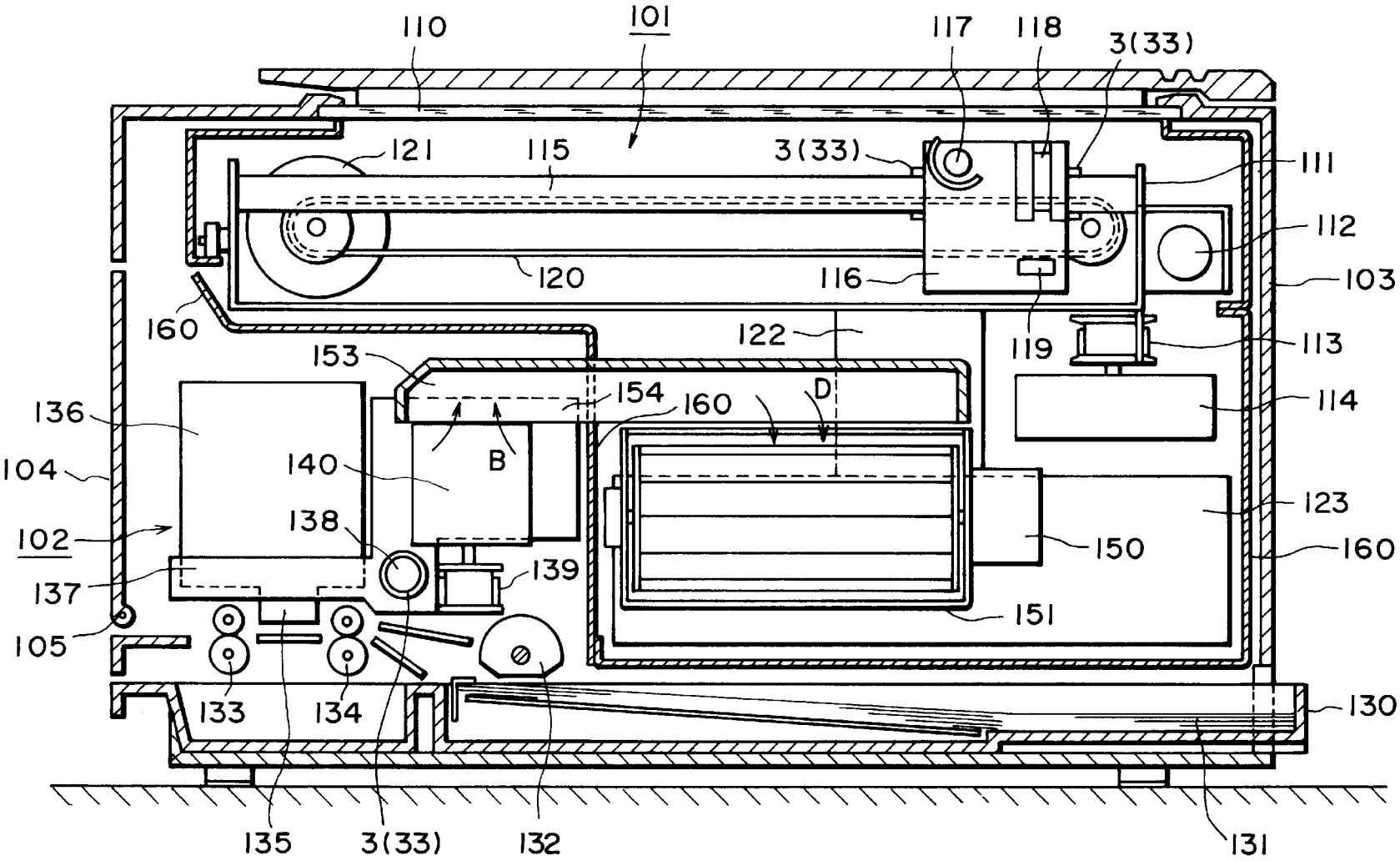
FIG. 19 is a sectional view of a copying apparatus to which the present invention is applied.

FIG. 19 shows a copying machine having a liquid jet recording type printer. The copying machine has an image reader 101, a printer 102, an outer casing 103, a door rotatable about a pin 105 at a front of the copying machine. When the recording head is to be exchanged, or when the jammed sheet is to be removed, the door 105 is opened. In this embodiment, a liquid jet recording head (ink jet recording head) of the printer 102 has 128 ejection outlets disposed at the pitch of 63.5 microns so as to cover 8.128 mm width by one scan. Correspondingly, the reader 101 has a reading width of 8.128 mm by one scan.

The reader 101 will be described. It comprises an original supporting platen 110 for supporting thereon an original to be read, which is made of glass or the like. It further comprises a sub-scan carriage 111 slidably engaged with a sub-scan rail 112 for reciprocation in a direction perpendicular to the sheet of the drawing, a belt 113 connected with a part of the sub-scan carriage 111 to reciprocate the sub-scan carriage 111, and a driving motor 114 for driving the sub-scan carriage 111 by way of the belt 113. The sub-scan carriage 111 has a main scan rail 115 and a main scan carriage 116 slidably engaged with the main scan rail 115. The carriage 116 is provided with a rub 117 for illuminating an original through the original supporting platen 110, an array 118 of lenses and light receiving element 119 for receiving light reflected from an original. The carriage 116 is connected with and endless belt 120, by which it is movable along the rail 115. One or more of the foregoing embodiments is usable for the bearing 3 (33) for the carriage 116. The apparatus further comprises a main scan motor 121 for moving the carriage 116 by way of the belt 120, and a cable for transmitting electric signals to which the detection by the light receiving element 119 is converted to a signal processor 123. An end of the cable 122 is connected with the sub-scan carriage 111, and the other end thereof is connected with the processor 123. Thus, the driving signals for the main scan motor 121 following the movement of the sub-scan carriage 111 and the image signals from the light receiving element 119 can be transferred with the processor 123.

When the reader 101 moves in the left-right direction in the Figure (main scan direction of the reader 116) below an unshown original on the original supporting platen 110, the image or the character information illuminated by the lamp 117 is read by the light receiving element 119 through the lens array 118, and by the sub-scan movement, the entire image or characters of the original can be read.

The image or the like thus read is transmitted from the light receiving element 119 as electric signals to the processor 123 and is processed thereby, and finally transmitted to the printer 102.

The printer 102 will be described. It comprises a cassette 130 for accommodating recording sheets 131, which is detachably mountable to the main assembly of the copying apparatus. A sheet supply roller 132 feeds one by one the recording sheet 131 from the cassette 130 to a recording sheet passage of the printer 102. The roller 132 is driven by an unshown motor and the associated system. A pair of rollers 133 and 134 function to feed the recording sheet 131 in the sub-scan direction (left-right direction in the Figure) in accordance with the recording operation, and is driven by an unshown motor. A liquid jet recording head 135 is constituted integrally with an ink container 135. The integral head (135) and container (136) are detachably mounted on the carriage 137. The carriage 137 is slidable on a main scan rail 138 and is connected with a belt 139. The carriage 137 is reciprocally movable in the main scan direction perpendicular to the sheet of the drawing along the rail 138 by a main scan motor 140 through the belt. Together with the movement, the recording head 135 ejects droplets of ink to the recording surface of the recording sheet established between the rollers 133 and 134, by which the recording is carried out in the width described hereinbefore. One or more of the embodiments described in the foregoing are applicable to the bearing 3 (33) of the carriage 137.

The printer 102 effects the print in the recording width read by the reader 101, on the recording sheet 131 by one main scan. After each main scan, the sheet is fed in the sub-scan direction by the rollers 133 and 134, so as to cover the entire surface of the original, and after completion of the recording, the recording sheet 131 is discharged to the outside of the casing 3.

Figure 20:
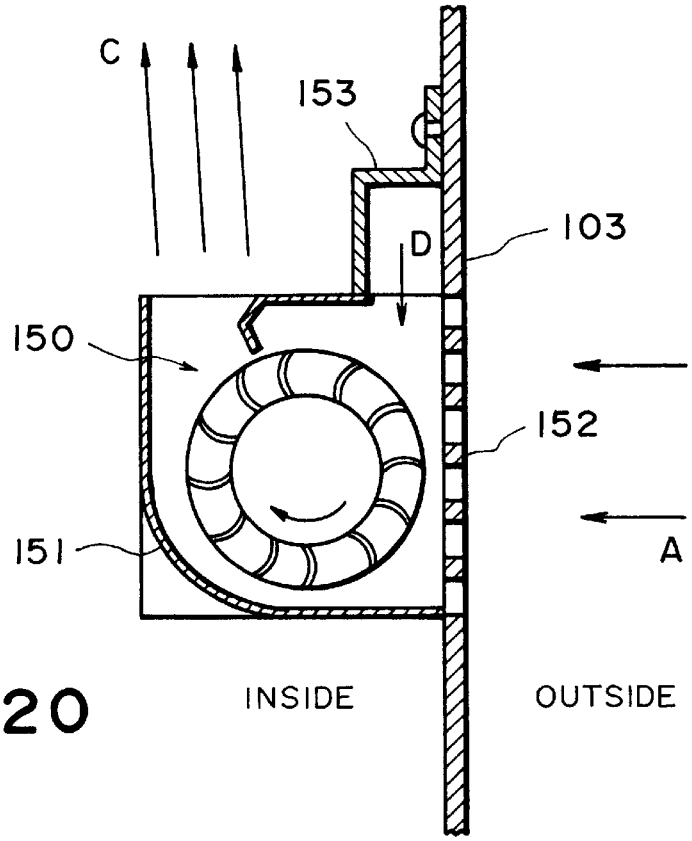
FIG. 20 is a sectional view of a cooling mechanism according to an embodiment of the present invention.
Figure 21:
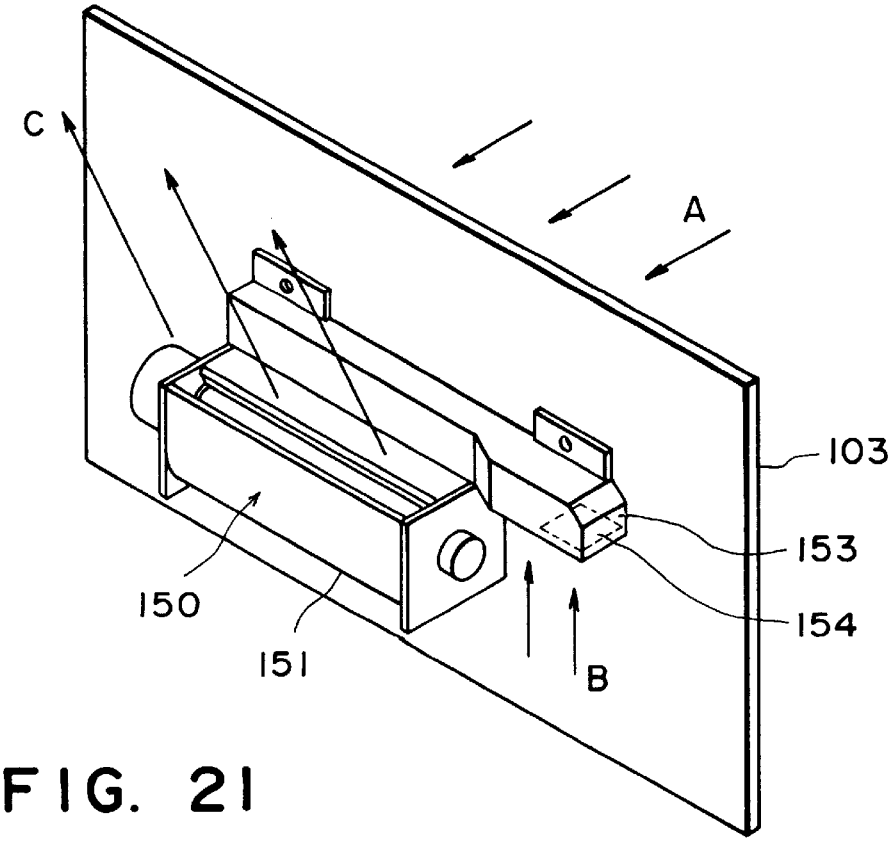
FIG. 21 is a perspective view of a cooling mechanism shown in FIG. 20.
Figure 22:
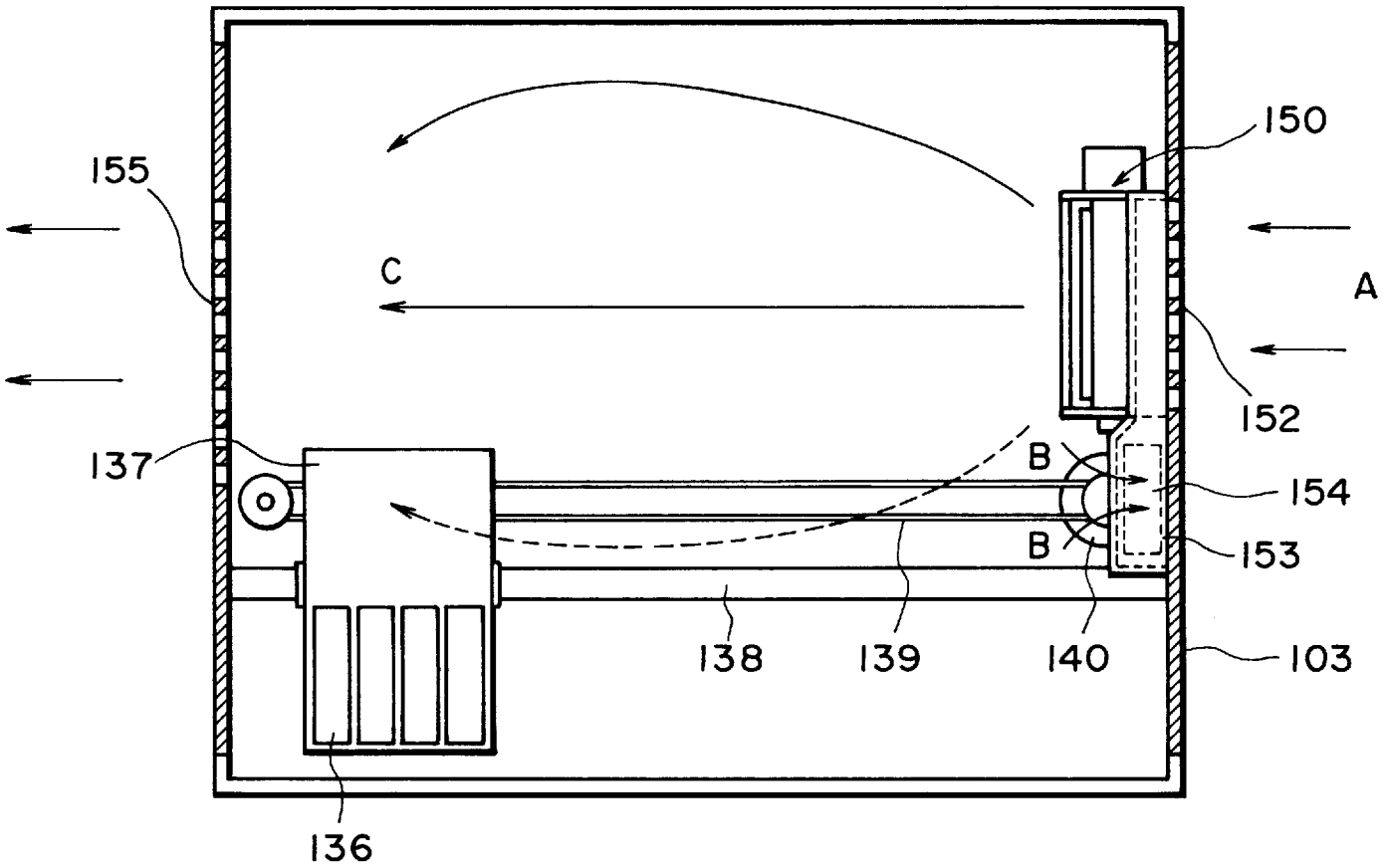
FIG. 22 is a top plan view of the cooling system of FIG. 19.

Referring to FIGS. 20–22, a cooling system of the copying apparatus of this embodiment will be described. FIG. 20 is a side sectional view as seen from the left of FIG. 19, of the cross-flow fan 150 and the housing 151. The cross-flow fan 150 is mounted in contact with a wall of the casing 103. A housing 151 of the cross-flow fan 150 has an opening, and a duct 153 is disposed to the opening.

FIG. 21 is a perspective view of the cross-flow fan 150. A duct 153 has a downward opening adjacent the cross-flow fan 131. The opening is a suction inlet 154, and therefore, the air is sucked from the outside of the duct in a direction B of FIG. 21.

With this structure, the air discharged by the cross-flow fan 150 is easily expanded toward the upward side of the copying machine, and the air tends to stagnate in the neighborhood of the cross-flow fan 150.

FIG. 22 is a top plan view of the copying apparatus without the reader 101. As will be understood, the air discharged by the cross-flow fan 150 is directed in the direction C, and is discharged outside of the apparatus through a louver 155.

As shown in FIG. 20, the cross-flow fan 150 is disposed in contact with the casing 103 of the apparatus (the front wall in FIG. 19). The fan 150 is provided with the housing 151 and a louver 152 opening to the mounting portion of the casing 103. The duct 153 is similarly contacted to the casing 103 above the louver 152 and mounted above the housing 151. The duct 153, as shown in FIG. 21, too, is in contact with the casing 103, and a suction opening 154 is opened at the bottom at an end.

The description will be made as to the flow of the air produced by the fan 150.

The opening position of the suction inlet 154 is disposed above the recording head main scan motor 140 which is a heat generating element and which is disposed at a position where the air discharged by the fan 150 does not reach, as show in FIG. 19. By doing so, the hot stagnated air adjacent the motor 140 is sucked in the direction B in FIGS. 20–22, by which the main scan motor 140 disposed adjacent to the fan 150 is cooled. In this embodiment, the motor 140 is in the form of a stepping motor, and therefore, it is not possible to mount a fan to the shaft thereof to cool the motor.

The sucked air is directed through the duct 153 and the opening of the housing 151 in the direction D (FIGS. 19 and 20). It is then mixed with the air introduced from the outside of the copying apparatus through the louver 152, and the mixture is finally directed in the direction C to the inside of the apparatus (FIGS. 20, 21 and 22).

In FIG. 22, a discharging louver 155 is mounted on the wall of the casing 103 opposite from the wall of the casing 103 on which the cross-flow fan 150 and the suction louver 152 are mounted. The outside air sucked through the suction louver 152 in the direction A (FIGS. 20, 21 and 22) and the air sucked from the suction inlet 154 of the copying apparatus and then in the direction D are mixed together, and the mixture is directed in the direction C to cool the lamp 117, and then is discharged through the discharging louver 155. Here, the air discharged in the direction C and cooling the lamp 117 is the mixture of the air having cooled the main scan motor 140 and having been sucked from the suction inlet 154 and the air introduced through the louver 152 from the outside of the copying machine. The temperature of the mixture is not high, because the fresh air is supplied from the louver 152, and is discharged to the other louver 155.

In this invention, "cooling" means removing the temperature rise of the ambience in the apparatus.

Between the reader 101 and the reader 102, a partition wall 160 is disposed, as shown in FIG. 19, and therefore, the air flow from the cross-flow fan 150 in the direction C is efficiently directed to the reader 101, and therefore, the air flow in the printer 102 is not influenced. The suction inlet 154 of the duct 153 is opened adjacent the printer 102, but the sucking action is not so strong to produce flow of air influential to the recording operation in the recording region.

Figure 23:
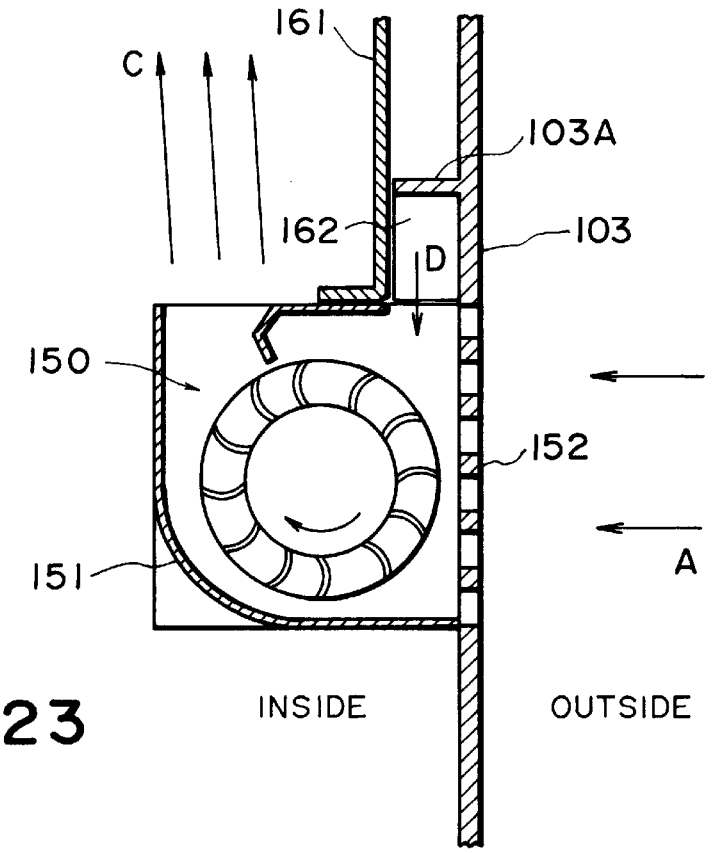
FIG. 23 is a sectional view illustrating a further embodiment of the present invention.

FIG. 23 shows a further embodiment, the Figure is similar to FIG. 20. In this embodiment, a rib 103A projected from the casing 103 and a frame 161 constituting the other part of the copying apparatus cooperate to establish a duct 162. According to this embodiment, the number of parts can be reduced, since no additional element is required to form the duct.

The construction of the duct 162 is not limited to that described above, but may be provided in any other form, if it provides the duct function. The advantageous effects in such cases are the same as described hereinbefore.

Figure 24:
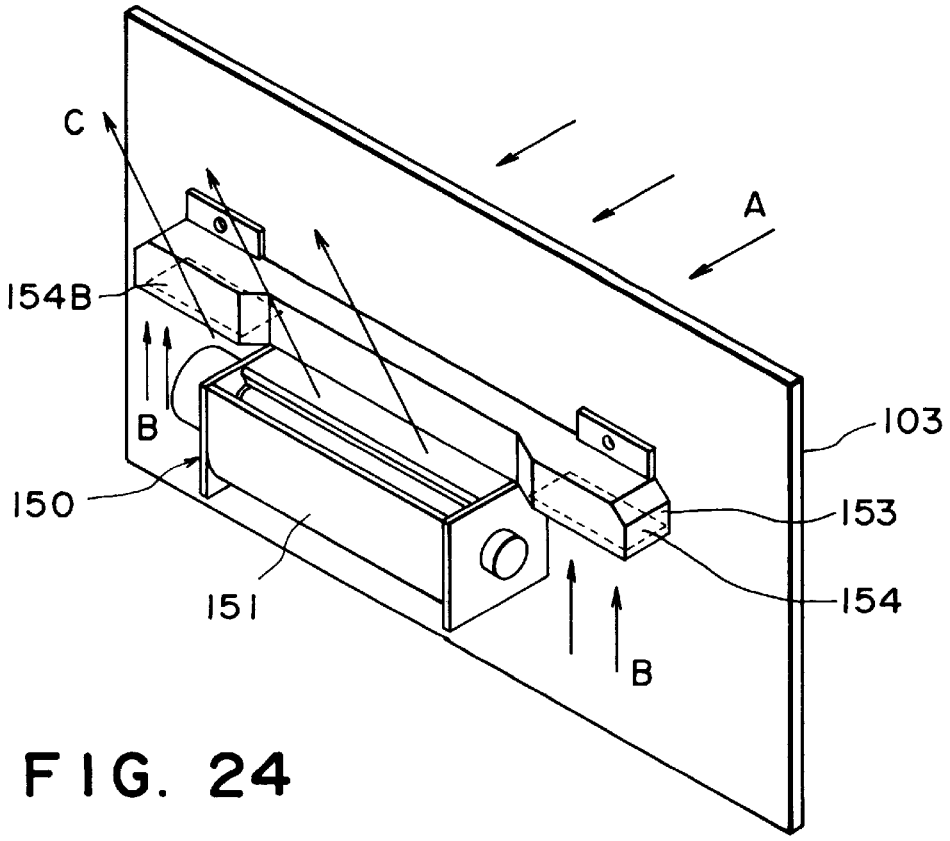
FIG. 24 is a perspective view illustrating a further embodiment of the present invention.

FIG. 24 shows a further embodiment. FIG. 24 shows this embodiment in the similar way as in FIG. 21. A duct 153 at the suction side of the cross-flow fan 150 is extended to both sides along the axis, in which the air can be sucked through two suction inlets 154A and 154B. According to this embodiment, the heat can be removed from two heat generating elements disposed at separate positions to cool them.

In this embodiment and in the two foregoing embodiments, the suction inlet is opened downward, but the direction of the opening may be changed, if it is directed to the heat generating element to be cooled.

In the foregoing embodiments, the number of suction inlets is one or two, but two or more suction inlets may be provided in accordance with the number or the circumstances of the heat generating elements disposed in the neighborhood of the cross-flow fan. In addition, the cooling effect can be enhanced by provision of a louver or opening for introducing the outside air at a position upstream of a heat generating element with respect to the detection of the air flow.

The foregoing description has been made with respect to the copying machine constituted by the reader and the printer, but the present invention is not limited to such a copying machine, but is applicable to a recording apparatus if it has a fixed heat generating element to be cooled using a cooling fan. The heat generating element may be plural driving motors, recording heads or an image fixing heater or the like.

The present invention is particularly suitably usable in a bubble jet recording head and recording apparatus developed by Canon Kabushiki Kaisha, Japan. This is because, the high density of the picture elements, and the high resolution of the recording are possible.

The typical structure and the operational principle are preferably those disclosed in U.S. Pat. Nos. 4,723,129 and 4,740,796. The principle is applicable to a so-called on-demand type recording system and a continuous type recording system. Particularly, however, it is suitable for the on-demand type because the principle is such that at least one driving signal is applied to an electrothermal transducer disposed on a liquid (ink) retaining sheet or liquid passage, the driving signal being enough to provide such a quick temperature rise beyond a departure from nucleation boiling point, by which the thermal energy is provided by the electrothermal transducer to produce film boiling on the heating portion of the recording head, whereby a bubble can be formed in the liquid (ink) corresponding to each of the driving signals. By the development and collapse of the bubble, the liquid (ink) is ejected through an ejection outlet to produce at least one droplet. The driving signal is preferably in the form of a pulse, because the development and collapse of the bubble can be effected instantaneously, and therefore, the liquid (ink) is ejected with quick response. The driving signal in the form of the pulse is preferably such as disclosed in U.S. Pat. Nos. 4,463,359 and 4,345,262. In addition, the temperature increasing rate of the heating surface is preferably such as disclosed in U.S. Pat. No. 4,313,124.

The structure of the recording head may be as shown in U.S. Pat. Nos. 4,558,333 and 4,459,600 wherein the heating portion is disposed at a bent portion in addition to the structure of the combination of the ejection outlet, liquid passage and the electrothermal transducer as disclosed in the above-mentioned patents. In addition, the present invention is applicable to the structure disclosed in Japanese Laid-Open Patent Application Publication No. 123670/1984 wherein a common slit is used as the ejection outlet for plural electrothermal transducers, and to the structure disclosed in Japanese Laid-Open Patent Application No. 138461/1984 wherein an opening for absorbing pressure waves of the thermal energy is formed corresponding to the ejecting portion. This is because, the present invention is effective to perform the recording operation with certainty and at high efficiency irrespective of the type of the recording head.

The present invention is effectively applicable to a so-called full-line type recording head having a length corresponding to the maximum recording width. Such a recording head may comprise a single recording head and plural recording heads combined to cover the entire width.

In addition, the present invention is applicable to a serial type recording head wherein the recording head is fixed on the main assembly, to a replaceable chip type recording head which is connected electrically with the main apparatus and can be supplied with the ink by being mounted in the main assembly, or to a cartridge type recording head having an integral ink container.

The provision of the recovery means and the auxiliary means for the preliminary operation are preferable, because they can further stabilize the effect of the present invention. As for such means, there are capping means for the recording head, cleaning means therefor, pressing or sucking means, preliminary heating means by the ejection electrothermal transducer or by a combination of the ejection electrothermal transducer and additional heating elements and means for preliminary ejection not for the recording operation, which can stabilize the recording operation.

As regards the kinds of the recording head mountable, it may be a single corresponding to a single color ink, or may be plural corresponding to the plurality of ink materials having different recording colors or densities. The present invention is effectively applicable to an apparatus having at least one of a monochromatic mode mainly with black, a multi-color mode with different color ink materials, and a full-color mode by the mixture of the colors which may be an integrally formed recording unit or a combination of plural recording heads.

Furthermore, in the foregoing embodiment, the ink has been liquid. It may be, however, an ink material solidified at the room temperature or below and liquefied at the room temperature. Since in the ink jet recording system, the ink is controlled within the temperature not less than 30° C. and not more than 70° C. to stabilize the viscosity of the ink to provide the stabilized ejection, in a usual recording apparatus of this type, the ink is such that it is liquid within the temperature range when the recording signal is applied. In addition, a temperature rise due to the thermal energy is positively prevented by consuming the thermal energy for the state change of the ink from the solid state to the liquid state, or the ink material that is solidified when it is left unused is used to prevent the evaporation of the ink. In either of the cases, with the application of the recording signal producing thermal energy, the ink may be liquefied, and the liquefied ink may be ejected. The ink may start to be solidified at the time when it reaches the recording material. The present invention is applicable to such an ink material as is liquefied by the application of the thermal energy. Such an ink material may be retained as a liquid or solid material in through holes or recesses formed in a porous sheet as disclosed in Japanese Laid-Open Patent Application No. 56847/1979 and Japanese Laid-Open Patent Application No. 71260/1985. The sheet is faced to the electrothermal transducers. The most effective one for the ink materials described above is the film boiling system.

The ink jet recording apparatus may be used as an output terminal of an information processing apparatus such as computer or the like, a copying apparatus combined with an image reader or the like, or a facsimile machine having information sending and receiving functions.

As described in the foregoing, according to the present invention, the carriage can be moved smoothly at all times, and the cross-flow fan is used to cool the heat generating element disposed in the neighborhood of the cross-flow fan, so that the cross-flow fan is capable of cool the reader and also the main scan stepping motor for the printer, and therefore, the operational accuracy of the various elements are enhanced, so that good operation can be maintained.

As described in the foregoing, according to the present invention, an extension is formed to receive the lubricant oil scraped by a bearing from the sliding surface, and the extension is connected with sliding surface or the like by a groove or grooves, by which the scraped oil is accumulated on the extension and is returned to the sliding surface in accordance with reduction of the lubricant oil at the sliding surface. Therefore, the service life of the lubricating system is significantly increased. According to another aspect of the present invention, the scraped lubricant oil is directed to an opposite side where it is collected, so that the loss of the lubricant oil is reduced, and the service life of the lubricating system is significantly increased. By the reduction of the loss of the oil, the total quantity of the oil used can be reduced.

While the invention has been described with reference to the structures disclosed herein, it is not confined to the details set forth and this application is intended to cover such modifications or changes as may come within the purposes of the improvements or the scope of the following claims.

What is claimed is:

1. A recording apparatus comprising:

a shaft;

a carriage, slidable on said shaft, for reciprocating a recording head;

a bearing member provided on said carriage, said bearing member including a sliding surface which is slidable on said shaft, an accumulating portion for receiving and accumulating lubricant oil removed from said sliding surface, a side surface extended continuously from said sliding surface and continuously to said accumulating portion, a guiding surface, provided in said side surface, for guiding the oil removed from said sliding surface to said accumulating portion, and a recess formed in said side surface and having an end which opens to said sliding surface and the other end which is at said accumulating portion to guide, to said sliding surface by capillary action, the oil accumulated in said accumulating portion as a result of reduction of the lubricant from the sliding surface.

2. An apparatus according to claim 1, wherein said accumulating portion is provided with a visor extending in an axial direction of said shaft.

3. An apparatus according to claim 2, wherein said visor has a length sufficient to retain thereon an entire amount of the oil removed from said sliding surface.

4. An apparatus according to claim 1, wherein said accumulating portion has a part for accumulating the oil, the part having a shape of approaching said shaft at a position away from said recess.

5. An apparatus according to claim 1, wherein said recording head is an ink jet recording head for ejecting ink to effect recording on a recording material.

6. An apparatus according to claim 5, wherein said ink jet recording head has an electrothermal transducer element for generating energy for ejecting ink.

* * * * *